US007203453B2

(12) United States Patent
Naito et al.

(10) Patent No.: US 7,203,453 B2
(45) Date of Patent: Apr. 10, 2007

(54) FIXING DEVICE

(75) Inventors: Yasutaka Naito, Kanagawa (JP); Hideaki Ohara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 104 days.

(21) Appl. No.: 11/075,743

(22) Filed: Mar. 10, 2005

(65) Prior Publication Data

US 2006/0029444 A1 Feb. 9, 2006

(30) Foreign Application Priority Data

Aug. 5, 2004 (JP) ..... P2004-229540

(51) Int. Cl.
*G03G 15/20* (2006.01)

(52) U.S. Cl. ..... 399/329; 399/328

(58) Field of Classification Search ..... 219/216, 219/619; 399/320, 322, 328–332
See application file for complete search history.

(56) References Cited

U.S. PATENT DOCUMENTS

| | | | | |
|---|---|---|---|---|
| 2003/0063931 | A1* | 4/2003 | Sanpei et al. | 399/328 |
| 2006/0182474 | A1 | 8/2006 | Naito et al. | 399/329 |

FOREIGN PATENT DOCUMENTS

| | | |
|---|---|---|
| JP | 7-281549 | 11/1955 |
| JP | 7-281461 | 10/1995 |
| JP | 2003-084591 | 3/2003 |
| JP | 2003-122149 | 4/2003 |
| JP | 2003-223064 | 8/2003 |

* cited by examiner

*Primary Examiner*—Hoang Ngo
(74) *Attorney, Agent, or Firm*—Morgan, Lewis & Bockius LLP

(57) ABSTRACT

A fixing device includes an endless fixing belt which is tensionless in a circumferential direction in a center part in a lateral direction and supported to circularly move, a heating device that heats the fixing belt, a pressure roll contacted with an outer peripheral face and supported to rotate around an axis, a pressure member contacted with an inner peripheral face to exert pressure on the pressure roll, and a support member passed through inside the fixing belt and supporting the pressure member. Preferably, an unfixed toner image on a recording medium passing the nip part which is formed between the fixing belt and the pressure roll is pressurized and heated to be formed into a fixed image, and the fixing belt is kept in a round shape in the circumferential direction near both side edges and supported to rotate around a center axis determined by the support member.

15 Claims, 8 Drawing Sheets

B-B

FIXING DEVICE

BACKGROUND OF THE INVENTION

1. Field of the Invention

The present invention relates to a fixing device which is employed in an image forming apparatus such as a printer, a copying machine, a facsimile, and adapted to heat and melt an unfixed toner image which is carried on a recording medium, thereby to fix it on the recording medium.

2. Description of the Related Art

Generally, as a process for fixing a toner image in an image forming apparatus using powdery toner, there has been widely adopted such a method that the toner image is transferred onto a recording medium electrostatically, or the toner image is secondarily transferred to the recording medium after it has been primarily transferred to an intermediate transfer body, thereafter, the recording medium is interposed between a heating member and a pressurizing member, and then, the toner image is heated thereby to be fixed on the recording medium under pressure.

One of the conventional fixing devices includes, for example, a fixing roll having a heating body such as a halogen lamp which is contained in a cylindrical core metal, and a pressure roll to be pressed with this fixing roll. A recording medium carrying an unfixed toner image thereon is interposed between the fixing roll and the pressure roll, and then, heated and pressurized.

The fixing device as described above lacks in quick starting performance, because it is difficult to decrease thermal capacity of the fixing roll, and a considerable waiting time is required until the fixing roll and so on are heated up from a completely cooled state to a determined fixable temperature, even though the halogen lamp which is a heat source for the fixing device is energized simultaneously when the image forming apparatus is switched on. Moreover, under waiting condition of the image forming apparatus (when an image is not outputted), the halogen lamp must be always energized to keep the fixing roll at a determined temperature so that image forming operation can be conducted any time, and therefore, high consumption of electric power is inevitable.

On the other hand, there has been such a fixing device in which an endless fixing belt is employed in place of the fixing roll. A type of the fixing belt is stretched by means of a plurality of support rolls, and another type of the fixing belt has a pressure member inside the belt, and is pressed by a pressure roll in a non-stretched state thereby to be driven to rotate. The fixing belt can be warmed up in a shorter time than the roll type member, because it has a thin walled heat resistant resin as a base layer, and thermal capacity is smaller as compared with the roll type member. Moreover, in the fixing belt of the non-stretched type, a contact area with respect to other members can be minimized, and heat transfer to the other members can be decreased. Consequently, more efficient warming up can be performed.

The fixing devices in which the fixing belt is driven to rotate in a non-stretched state are disclosed in JP-A-07-281461 and JP-A-2003-223064. In these fixing devices, a guide member and a heat source are provided inside the fixing belt which is in an endless state, so that the fixing belt is rotatably supported and heated from the inside. A pressure roll is contacted with an outer peripheral face of the fixing belt, and pressed onto the guide member thereby to form a fixing nip. When this pressure roll is driven to rotate, the fixing belt will be rotated with a friction force in the fixing nip. Then, the recording medium carrying the unfixed toner image will be brought into contact with the fixing belt while passing through the fixing nip, and then, heated and pressurized between the guide member and the pressure roll, whereby the toner image will be fixed on the recording medium.

Moreover, described in JP-A-2003-84591 is a fixing device in which a fixing belt in a substantially non-stretched state is heated by an electromagnetic induction heater. Specifically, the fixing belt is provided with an electrically conductive layer which is heated by induced current, along its peripheral face, and an exciting coil is arranged so as to be opposed to the outer peripheral face of the fixing belt. Variable magnetic field induced by this exciting coil induces eddy current in the electrically conductive layer of the fixing belt to heat it up. Moreover, in this fixing device, a center part of the fixing belt is in a state where almost no tension is exerted in a circumferential direction, but in side edge parts thereof, a guide member is contacted with the inner peripheral face of the fixing belt in the circumferential direction, so that deformation and swing of the fixing belt may be restrained.

On the other hand, disclosed in JP-A-2003-122149 and JP-A-07-281549 are fixing devices in which rotation driving force is given from side edge parts of a fixing belt in a non-stretched state. In the fixing device disclosed in JP-A-2003-122149, both side edges of the fixing belt (a fixing film) in an endless state have concaves and convexes in a circumferential direction and rotation receiving members are engaged with these concaves. Driving force is transmitted to these rotation receiving members thereby to drive the fixing belt. In the fixing device disclosed in JP-A-07-281549, the fixing belt is provided with projections in a cogwheel shape in side edge parts thereof, and a driving gear is meshed with the projections to give the driving force to the fixing belt. There is further disclosed, in JP-A-07-281549, the fixing device in which the fixing belt is provided with engaging holes which are circumferentially arranged in the side edge parts thereof, and adapted to be engaged with engaging projections formed on a peripheral face of the roll type member thereby to transmit the driving force.

However, the fixing device employing the above described fixing belt in a non-stretched state has had the following problems to be solved.

In the fixing devices disclosed in the above described JP-A-07-281461, JP-A-2003-223064 and JP-A-2003-84591, the rotation driving force of the fixing belt is transmitted by friction force from the pressure roll which is pressure contacted with the outer peripheral face of the fixing belt. Moreover, the guide member is pressure contacted with the inner peripheral face of the fixing belt, and the fixing belt performs sliding movement. Accordingly, in an initial period of using the device, a sliding face thereof is in good condition, and the fixing belt can be driven to rotate with no problem in association with the rotation of the pressure roll. However, as the device is continuously used, interior sliding resistance will rise, and rotation speed of the fixing belt may be sometimes delayed with respect to rotation of the pressure roll. This is due to a slip which has happened on a contact face between the fixing belt and the pressure roll, and will be a cause for instability of an image to be fixed on the recording medium, or occurrence of paper wrinkles in the recording medium.

Moreover, as temperature of the pressure roll rises, thermal expansion occurs in material which the peripheral face of the pressure roll is formed of, and a length of the peripheral face is made longer. When this pressure roll is driven to rotate at a determined rotation number, driving speed of the fixing belt will vary according to the temperature of the pressure roll. Then, it is concerned that unbalance in speed may happen with respect to a transfer step in which the recording medium is conveyed always at a constant speed, and instability of the image or wrinkle of paper may occur.

Moreover, in the fixing devices disclosed in JP-A-07-281461 and JP-A-2003-223064, an orbit of the fixing belt is not sufficiently restrained except the nip part, and a swing of the belt or a sway of the belt in a direction perpendicular to the peripheral face may happen, while the belt is driven. Such positional instability of the belt may sometimes cause variations in distance between the belt and the exciting coil which is opposed to the belt, and unevenness in heating temperature may occur. As the results, the fixed image may be damaged.

On the other hand, in the device disclosed in JP-A-2003-84591, the fixing belt hardly swings because a shape of the fixing belt is restrained in the side edge parts thereof. However, the guide member provided on the inner face scrapes the inner peripheral face of the fixing belt while sliding along the circumferential direction, which increases friction. Moreover, in case where the guide member on the inner face has been made larger in diameter to apply tension to the fixing belt from inside at both end parts thereof, larger frictional force will be exerted, and the rotation speed of the fixing belt will be more liable to be lowered.

Further, in the devices disclosed in JP-A-2003-122149 and JP-A-07-281549, there is such an anxiety that necessity of adding delicate works on a thin film metal sleeve or an endless belt which is used as the fixing belt may happen, or stress may be concentrated on end parts of the thin film metal sleeve and engaging holes in the endless belt, and breakage or fatigue failure may arise from these parts.

SUMMARY OF THE INVENTION

This invention has been made in order to solve the above described problems, and the invention provides a fixing device which can be reliably driven at a determined speed to obtain a favorable fixed image, without causing a swing or sway in the fixing belt in a non-stretched state.

According to an aspect of the present invention, a fixing device includes an endless fixing belt which is tensionless in a circumferential direction in a center part thereof in a lateral direction and supported to circularly move, a heating device that heats the fixing belt, a pressure roll which is contacted with an outer peripheral face of the fixing belt and supported to rotate around an axis of the pressure roll, a pressure member which is contacted with an inner peripheral face of the fixing belt to exert pressure on the pressure roll interposing the fixing belt, and a support member which is passed through inside the fixing belt and supports the pressure member. Preferably, a fixing nip part is formed between the fixing belt and the pressure roll, an unfixed toner image on a recording medium which passes the nip part is pressurized and heated to be formed into a fixed image, the fixing belt is kept in a round shape in the circumferential direction near both side edges of the fixing belt, and the fixing belt is supported to rotate around a center axis which is determined by both end parts of the support member.

According to another aspect of the present invention a fixing device includes a hollow fixing roll which is tensionless in a circumferential direction in a center part thereof in a lateral direction and supported to circularly move, a heating device that heats the fixing roll, a pressure roll which is contacted with an outer peripheral face of the fixing roll and supported to rotate around an axis of the pressure roll, a pressure member which is contacted with an inner peripheral face of the fixing roll to exert pressure on the pressure roll interposing the fixing roll, and a support member which is passed through inside the fixing roll and supports the pressure member. Preferably, a fixing nip part is formed between the fixing roll and the pressure roll, an unfixed toner image on a recording medium which passes the nip part is pressurized and heated to be formed into a fixed image, the fixing roll is kept in a round shape in the circumferential direction near both side edges of the fixing roll, and the fixing roll is supported to rotate around a center axis which is determined by both end parts of the support member.

BRIEF DESCRIPTION OF THE DRAWINGS

Embodiment of the present invention will be described in detail based on the following figures, wherein.

DETAILED DESCRIPTION OF THE INVENTION

Figure 1:
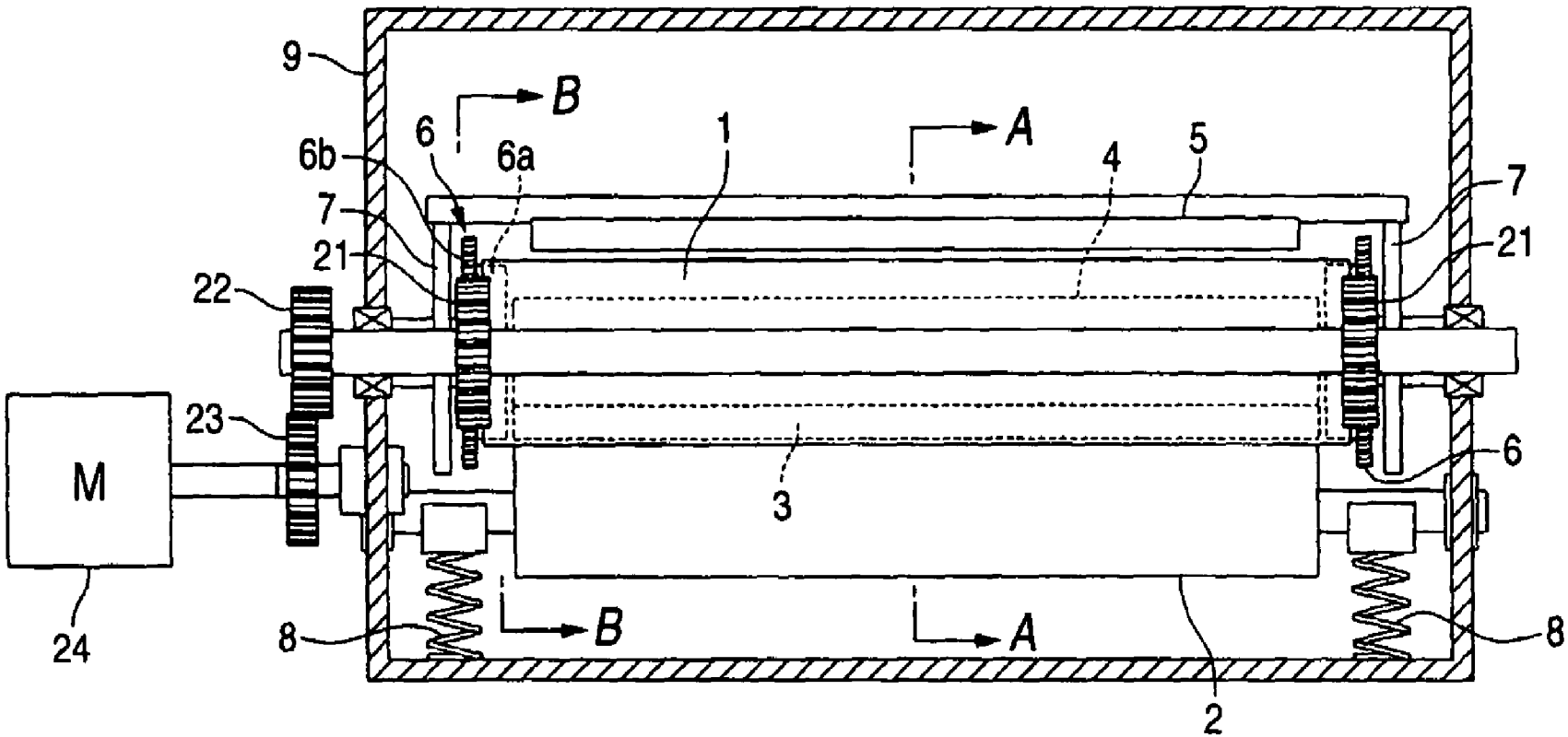
FIG. 1 is a front view schematically showing a fixing device in an embodiment of the invention according to the application.

The invention of a first aspect is a fixing device including an endless fixing belt which is tensionless in a circumferential direction in a center part thereof in a lateral direction, and supported so as to circularly move, a heating device that heats the fixing belt, a pressure roll which is contacted with an outer peripheral face of the fixing belt and supported so as to rotate around its axis, a pressure member which is contacted with an inner peripheral face of the fixing belt to exert pressure on the pressure roll interposing the fixing belt, and a support member which is passed through inside the fixing belt and supports the pressure member, wherein a fixing nip part is formed between the fixing belt and the pressure roll, and an unfixed toner image on a recording medium which passes the nip part is pressurized and heated to be formed into a fixed image, characterized in that the fixing belt is kept in a round shape in the circumferential direction near its both side edges, and supported so as to rotate around a center axis which is determined by both end parts of the support member.

In this fixing device, because both the end part of the fixing belt is kept in a round shape in cross section, and its rotation is fixed by the support member, a track of the rotary motion of the belt can be made constant. Therefore, the fixing belt will be prevented from swaying in a direction perpendicular to the peripheral face thereof, and can be driven in a stabilized state. Consequently, even in case where the electromagnetic induction heater is provided so as to be opposed to the peripheral face of the fixing belt, a determined distance will be kept from the peripheral face, and uniform heating can be performed. Moreover, such an accident that the heater may be contacted with the recording medium carrying the unfixed toner image in the upstream of the fixing nip part to disturb the toner image or to make the image roughed can be prevented.

The invention of a second aspect is the fixing device characterized in that in the fixing device of the first aspect, end part restraining members provided with curved faces having an outer diameter substantially equal to an inner diameter of the fixing belt are fitted to both the side edge parts of the fixing belt inside the fixing belt, and the end part restraining members are rotatably fixed to the end parts of the support member.

In this fixing device, the end part restraining members become integral with the fixing belt, and are rotated around the end parts of the support member, as the center shafts. Therefore, the circular movement of the fixing belt can be smoothly performed in a stabilized state. Moreover, bearings or the like can be provided between the end parts of the support member and the end part restraining members, and it will be possible to minimize friction resistance to the least in these areas.

Further, because a space inside the fixing belt is closed, a lubricant in a liquid state will not leak to the exterior, if it is contained between the pressure member provided inside and the fixing belt.

The invention of a third aspect is in the fixing device characterized in that in the fixing device of the second aspect, further includes a driving unit that transmits rotation driving force to the end part restraining members.

In this fixing device, because the end part restraining members are driven to rotate, the fixing belt can be driven to rotate always at a determined speed, by way of these end cap restraining members. Therefore, disturbance of the toner image or formation of paper wrinkles can be avoided. Moreover, the driving force can be transmitted to the fixing belt by way of the end part restraining members as described above, and also from the pressure roll in contact with the outer peripheral face of the fixing belt to the fixing belt. By constructing in this manner, it is possible to drive the fixing belt at the determined speed reliably, even though frictional force is exerted between the pressure member and the fixing belt.

The invention of a fourth aspect is the fixing device characterized in that in the fixing device of the first aspect, the fixing belt has an electrically conductive layer along its peripheral face, the heating device is arranged so as to be opposed to the peripheral face of the fixing belt, and generates eddy current in the electrically conductive layer thereby to heat it up, and a position where the heating device is arranged is restricted by positioning members which are mounted on the center axis that supports the fixing belt.

In this fixing device, the position of the heating device is restricted with respect to the center axis, and the heating device can be always kept at a determined distance from the fixing belt which rotates around the same center axis. Accordingly, when the electrically conductive layer of the fixing belt is rapidly heated by the induction current in the state where the fixing belt has been driven to rotate, variations in heating temperature will hardly happen, and uniform heating can be conducted. As the results, the toner image which has been fixed will be a favorable image without irregularity of luster or offset.

As described herein above, in the fixing device according to the invention, although the fixing belt is in anon-stretched state in the center part in the lateral direction, because tension in the circumferential direction is not introduced, stable movement of the fixing belt can be performed along the determined orbit in the circumferential direction. Moreover, it is possible to drive the fixing belt by way of the end part restraining members, enabling the fixing belt to be rotated at the constant speed correctly, and disturbance of the toner image on the recording medium which is passed between the fixing belt and the pressure roll will be avoided.

An embodiment of the invention according to this application will be described referring to the drawings.

Figure 2:
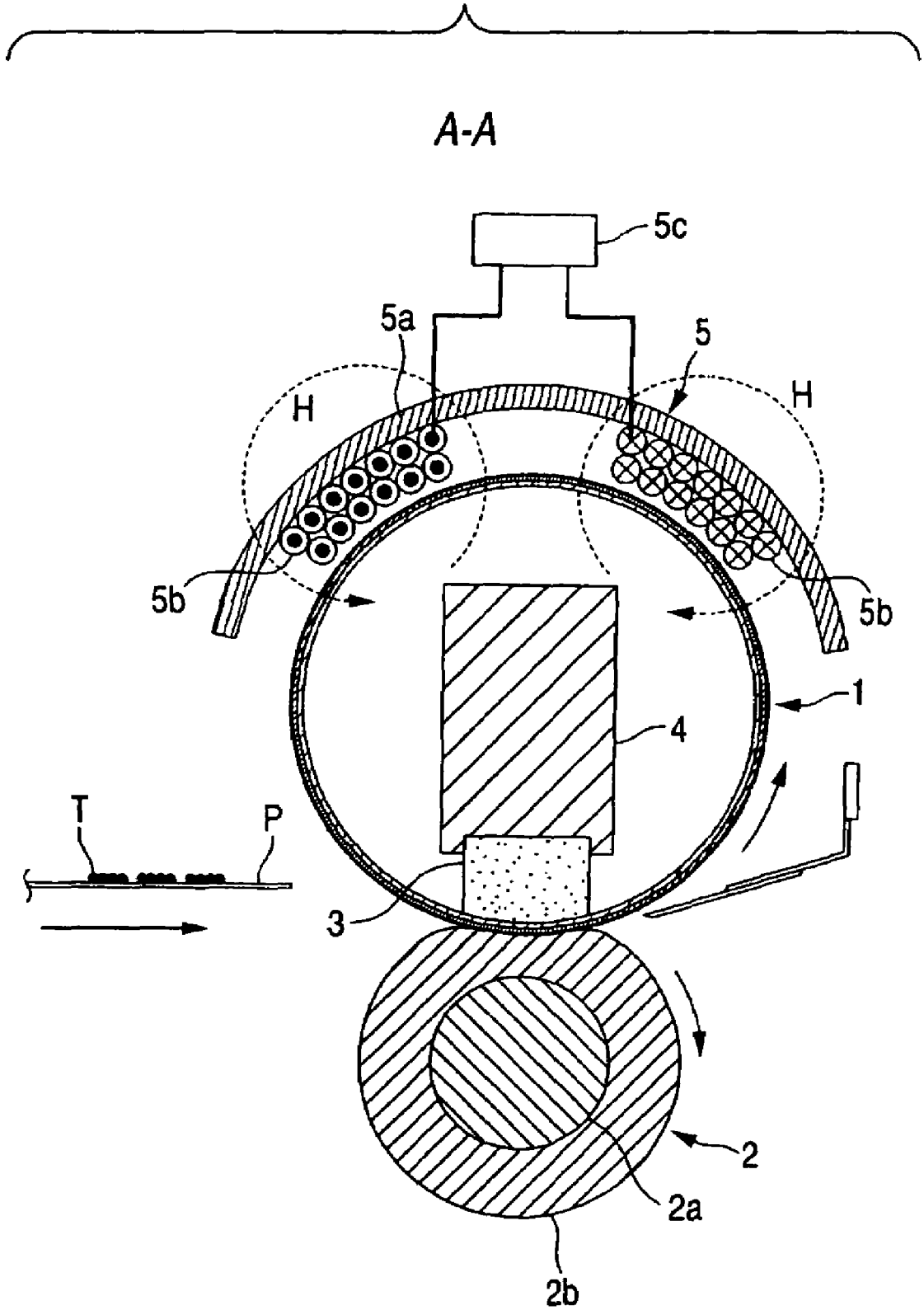
FIG. 2 is a cross sectional view taken along a line A—A in FIG. 1.
Figure 3:
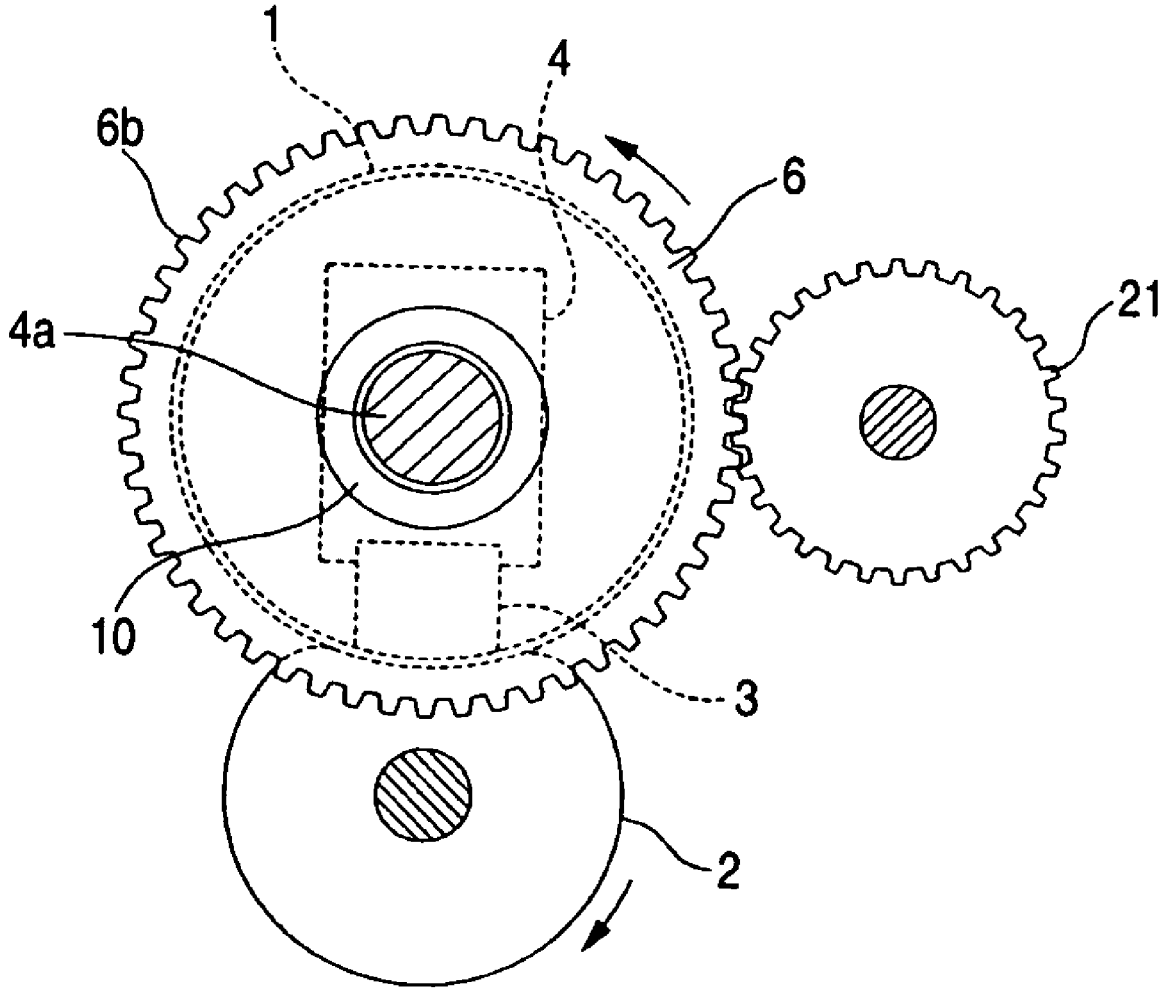
FIG. 3 is a cross sectional view taken along a line B—B in FIG. 1.
Figure 4:
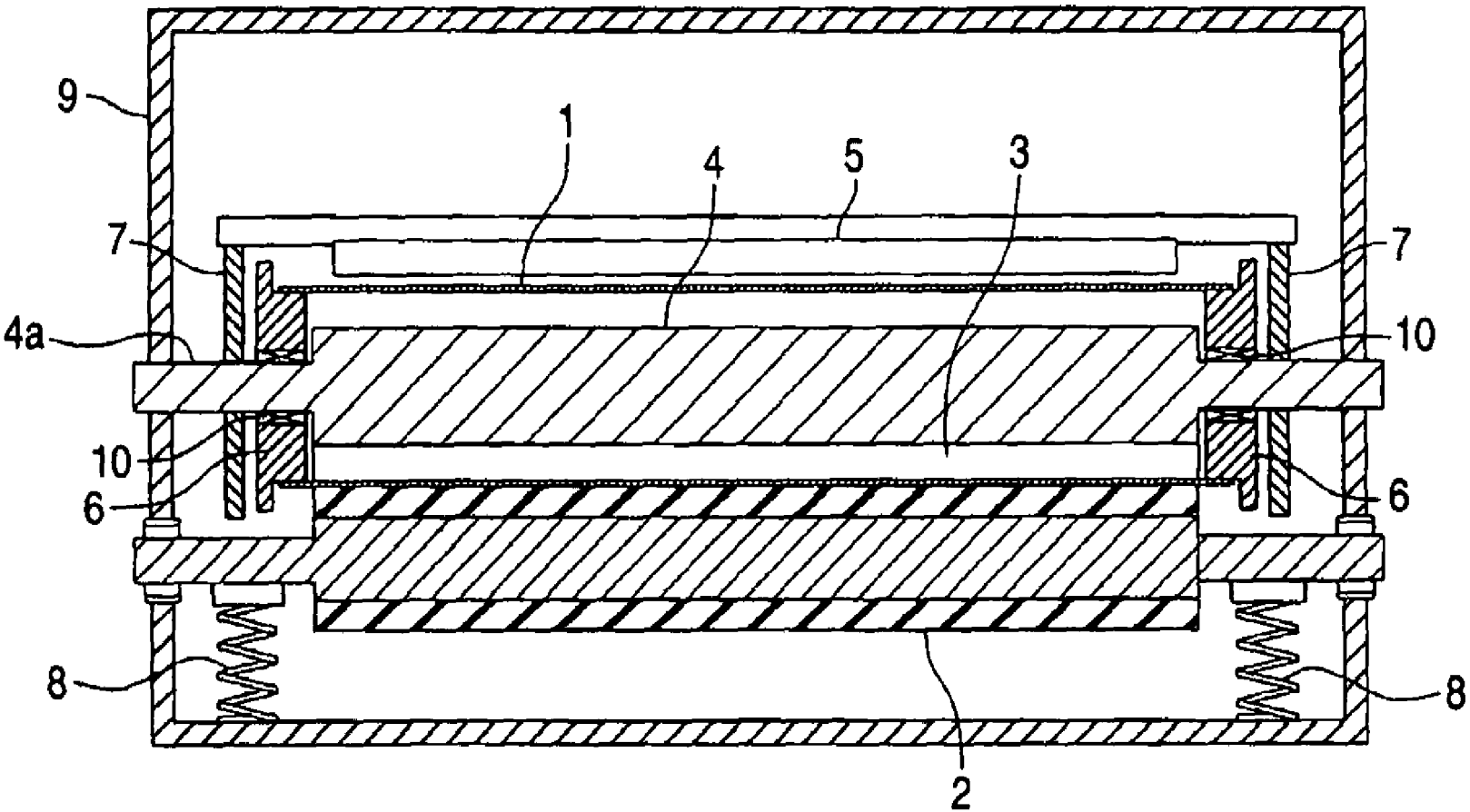
FIG. 4 is a sectional view of the fixing device as shown in FIG. 1 taken along an axial direction of a fixing belt and a pressure roll.
Figure 5:
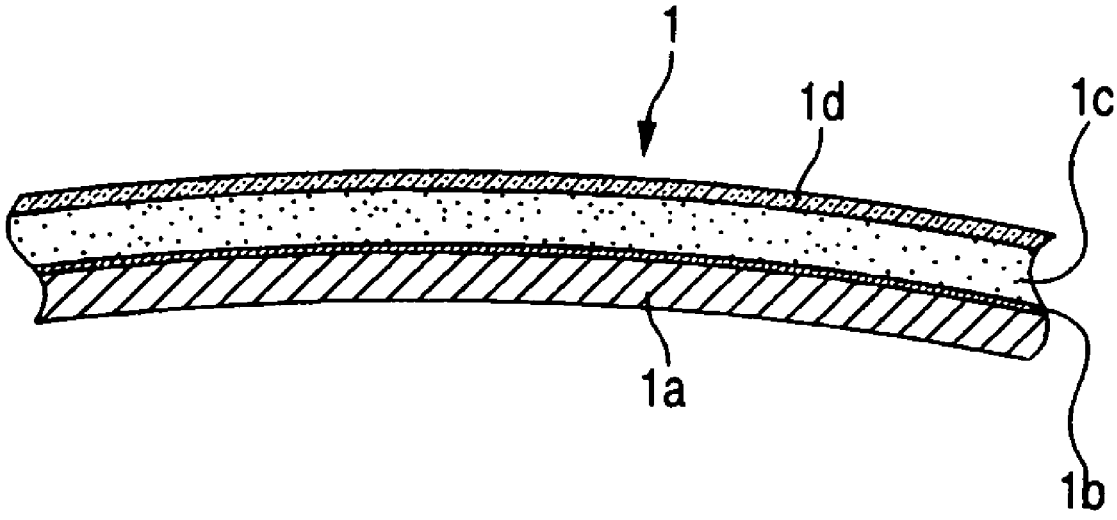
FIG. 5 is an enlarged sectional view of the fixing belt which is employed in the fixing device as shown in FIG. 1.

FIG. 1 is a front view schematically showing a fixing device which is one of embodiments of the invention according to the application. FIGS. 2 and 3 are cross sectional views of the same fixing device, and FIG. 4 is a longitudinal sectional view of the same.

This fixing device includes a fixing belt 1 having an endless peripheral face, a pressure roll 2 which is contacted with an outer peripheral face of this fixing belt 1 and driven to rotate in association with movement of the fixing belt, a pressure pad 3 which is contacted with an inner peripheral face of the fixing belt 1 and holds the fixing belt 1 between itself and the pressure roll 2, a pad support member 4 for supporting the pressure pad 3, an electromagnetic induction heater 5 which is provided along an outer peripheral face of the fixing belt 1 to heat the fixing belt 1, and end cap members (end part restraining members) 6 which are engaged with both end parts of the fixing belt 1 thereby to restrain the end parts so as to be round in a sectional shape, and adapted to be driven to rotate in a circumferential direction of the fixing belt 1.

The aforesaid fixing belt 1 is composed of, from inside, a base layer 1*a* formed of a sheet-like member having high heat resistance, an electrically conductive layer 1*b* laminated thereon, an elastic layer 1*c* further laminated thereon, and a surface releasing layer 1*d* which is the uppermost layer. In addition, a primer layer for bonding, a protective layer for a heating layer and so on may be provided between the respective layers.

As the base layer 1*a*, resin having high heat resistance and a thickness of 10 to 150 μm, more preferably 50 to 100 μm, for example, is employed. In this embodiment, a sheet-like member formed of polyimide having a thickness of 80 μm is used.

The aforesaid electrically conductive layer 1*b* is a layer which is induced and heated by a magnetic filed energized by the electromagnetic induction heater 5, and formed of metal such as iron, cobalt, nickel, copper, aluminum, chrome into a layer having a thickness of about 1 to 80 μm. Material and thickness of the electrically conductive layer 1*b* are selected considering specific resistance values thereof, so that sufficient heat can be obtained with an eddy current generated by electromagnetic induction. In this embodiment, copper having a thickness of about 10 μm is employed.

The elastic layer 1*c* is a layer having a thickness of 10 to 500 μm, more preferably 50 to 500 μm, and formed of silicone rubber, fluorine rubber, fluorosilicone rubber, etc. having excellent heat resistance and heat conductivity. In this embodiment, silicone rubber having a rubber hardness of 15° (JIS-A), and a thickness of 200 μm is employed.

The aforesaid surface releasing layer 1*d* is a layer which is directly contacted with the unfixed toner image transferred on the recording paper, and so, must be formed of material having good releasing performance. As material for forming this surface releasing layer 1*d*, there are, for example, tetrafluoroethylen/fluoroalkylvinylether polymer (PFA), polytetrafluoro-ethylen (PTFE), silicone resin, silicone rubber, fluorine rubber, etc. In this embodiment, PFA having a thickness of 30 μm is employed.

The aforesaid pressure roll 2 is supported at a position where its peripheral face is opposed to the peripheral face of the fixing belt 1, and both end parts thereof are urged toward the fixing belt 1 by means of springs 8. The pressure roll 2 has a cylindrical member 2*a* made of metal, as a core member, and on a surface of this cylindrical member 2*a*, there are provided an elastic layer 2*b* formed of silicone rubber, fluorine rubber, etc. having high heat resistance, and a surface releasing layer (not shown) on an utmost surface. This pressure roll 2 is driven to rotate in association with the rotation of the fixing belt 1. In this embodiment, the pressure roll 2 is urged toward the pressure pad 3 by way of the fixing belt 1, under a total load of 294N (30 kgf).

The aforesaid pressure pad 3 is formed of elastic material such as silicone rubber, fluorine rubber, or heat resistant resin such as polyimide resin, polyphenylensulfide (PPS), polyethersulfone (PES), liquid crystal polymer (LCP). This pressure pad 3 is provided over a somewhat larger region than a paper passing region of the fixing belt 1 in a lateral direction thereof, and the pressure roll 2 is pressed along substantially the total length of the pressure pad 3.

A sectional shape of the pressure pad 3 on a plane in contact with the fixing belt 1 can be arbitrarily set, according to paper releasing characteristics and fixing characteristics required for the fixing device. In this embodiment, the sectional shape of the pressure pad 3 has a curved face having substantially same curvature as the fixing belt 1 whose shape is restrained by the end cap members 6. However, for the purpose of further enhancing the releasing characteristics and fixing performance, the curvature of the pressure pad 3, that is, the sectional shape thereof may vary on the contact plane. In the fixing device having such a characteristic sectional shape of the pressure pad, the sectional shape of the pressure pad is not kept round in the paper passing region in the lateral direction. However, by making a distance from both ends of the pressure pad to both the end parts of the fixing belt where the end cap members are engaged sufficiently long, the fixing belt can be smoothly deformed from the shape in the paper passing region into the shape in both the end parts, and the sectional shape of the fixing belt can be kept round in its both side edge parts. Then, by applying driving force in a circumferential direction, the fixing belt will be driven to rotate drawing a determined orbit, without causing buckling and irregular rotation.

Moreover, a glass fiber sheet or the like impregnated with fluorine resin having good sliding performance and high abrasion resistance may be interposed between the pressure pad 3 and the fixing belt 1. Further, releasing agent such as silicone oil may be applied to the inner face of the fixing belt, as a lubricant. This will decrease friction resistance between the fixing belt 1 and the pressure pad 3, enabling the fixing belt 1 to be smoothly rotated.

Figure 6:
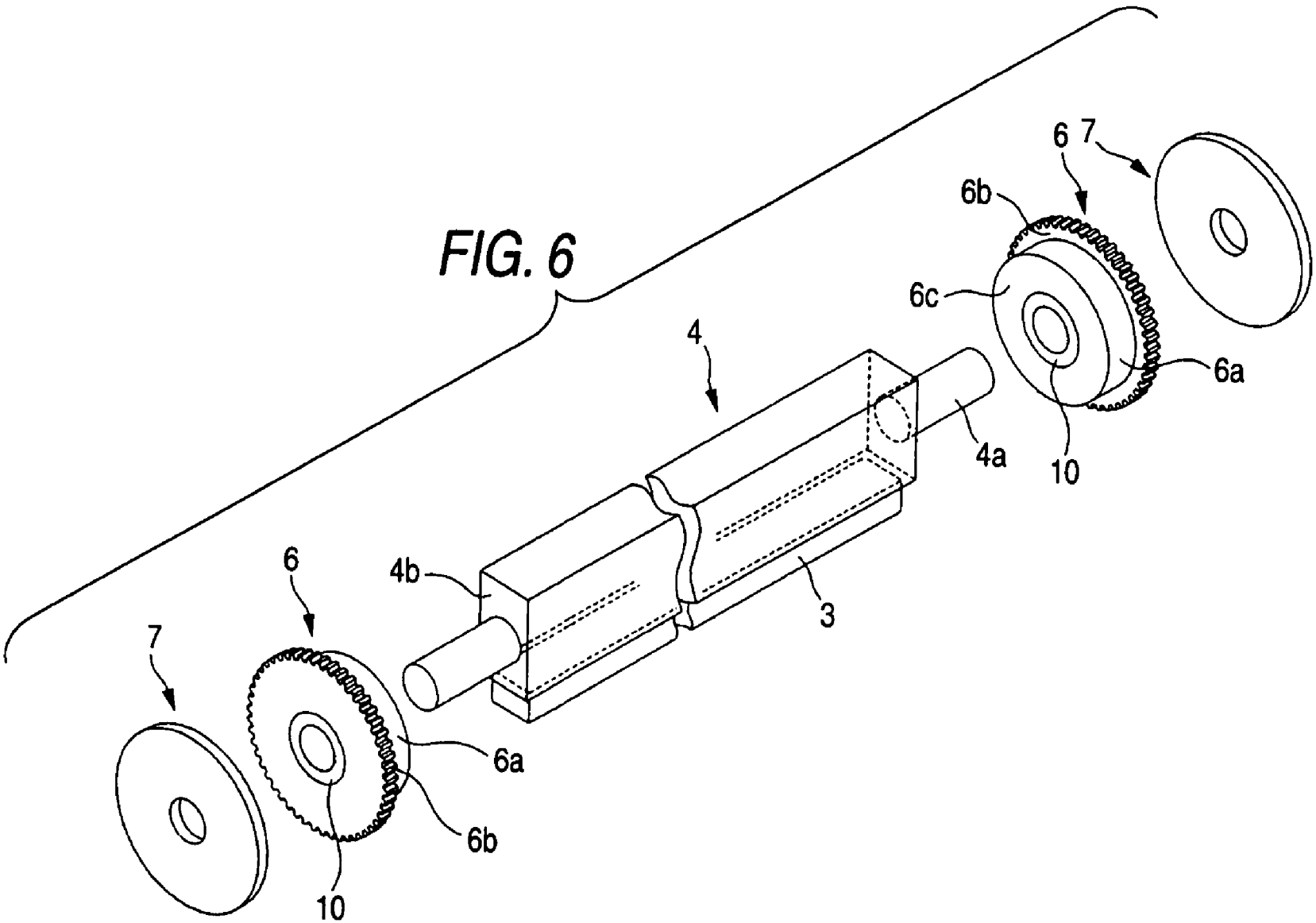
FIG. 6 is an exploded perspective view showing a pad support member, a pressure pad, end cap members and coil positioning members which are employed in the fixing device as shown in FIG. 1.
Figure 7A:
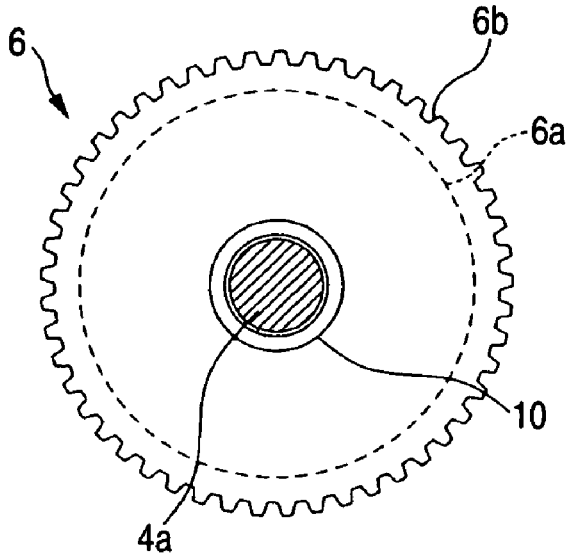
FIG. 7A is a front view of the end cap member which is employed in the fixing device as shown in FIG. 1.
Figure 7B:
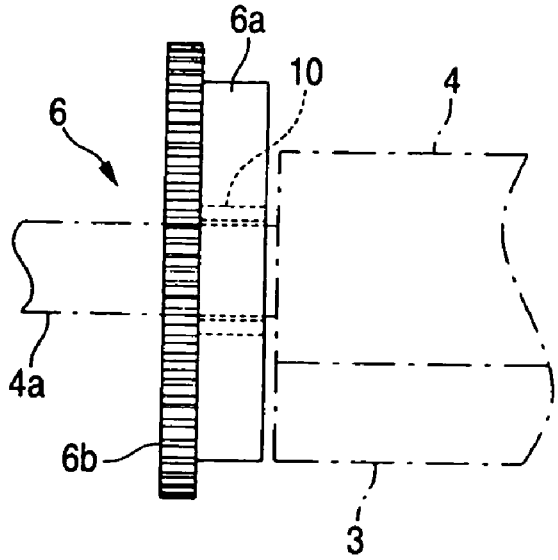
FIG. 7B is a side view of the same.

The aforesaid pad support member 4 is a rod-like member having an axis in a lateral direction of the fixing belt 1, and has such a shape that shafts 4*a* are projected from both end parts thereof, as shown in FIG. 6. These shafts 4*a* are fixed to a frame 9 of the fixing device, and the end cap members 6 are held by way of bearings 10 so as to be rotated around axes of the shafts 4*a*. The pressure pad 3 is attached to the pad support member 4 at a position opposed to the pressure roll 2, and pressure which is exerted on the pressure pad 3 from the pressure roll 2 by way of the fixing belt 1 will be borne by this pad support member 4.

Material for the pad support member 4 is selected from materials which have such rigidity that an amount of flexure when they have received contact pressure from the pressure roll 2 is below a certain level, preferably 1 mm or less, and which are not heated under influence of a magnetic flux by the electromagnetic induction heater 5. For example, the heat resistant resin such as PPS (polyphenylenesulfide) containing glass fibers, phenol, polyimide, liquid crystal polymer, heat resistant glass, metal such as aluminum which has small specific resistance and hardly affected by the inductive heating may be employed.

The aforesaid end cap members 6 include, as shown in FIGS. 3, 6, 7A and 7B, engaging parts 6*a* in a substantially cylindrical shape which are respectively inserted inside of the side edge parts of the fixing belt 1, and gear parts 6*b* each having a larger diameter than the engaging part 6*a* and protruded in a radial direction, to which the rotation driving force is transmitted. The bearings 10 which are rotatably coupled to the shafts 4*a* of the pad support member 4 are respectively attached to center parts of the end cap members 6. The end cap members 6 are supported in such a manner that faces 6*c* at a side of the paper passing region are respectively opposed to end faces 4*b* of the pad support member 4.

The aforesaid engaging parts 6*a* are fitted into the both side edge parts of the fixing belt 1 to restrain so that the sectional shape of the fixing belt 1 in the side edge parts may be kept round. By applying an adhesive agent between the fixing belt 1 and the engaging parts 6*a* of the end cap members, or by making an outer diameter of the engaging parts 6*a* somewhat larger than an inner diameter of the fixing belt 1, the engaging parts 6*a* can be fixed to the fixing belt by being engaged with each other. Alternatively, by tightening the fixing belt 1 with a ring-like band (not shown) around the outer peripheral face thereof, the fixing belt 1 can be fixed to the end cap members 6 in a tight contact with the engaging parts 6*a*. By fixing the fixing belt to the end cap members in this manner, the rotation driving force which has been transmitted to the gear parts 6*b* will be transmitted from the end cap members 6 to the fixing belt 1, and both the members will be driven to rotate together.

As material for the end cap members 6, so-called engineering plastics which have excellent mechanical characteristics, high insulating performance, and good heat resistance may be employed. For example, phenol resin, polyimide resin, polyamide resin, ployamideimide resin, PEEK resin, PES resin, PPS resin, LCP resin, and so on can be selected.

The bearings 10 are respectively fixed to the end cap members 6 in such a manner that center axes thereof are coaxial with peripheral faces of the engaging parts 6*a*, and the end cap members 6 are rotatably supported by the shafts 4*a* provided in the end parts of the pad support member 4, by way of these bearings 10. The pressure pad 3 attached to the pad support member 4 is formed in such a manner that its face to be contacted with the inner peripheral face of the fixing belt 1 may be substantially correspond to a phantom curved face which is extended from the engaging parts 6*a*. Therefore, when the fixing belt 1 is driven with the rotation of the end cap members 6, the fixing belt 1 will be smoothly rotated around the shafts 4*a* of the pad support member 4, and will be hardly deformed. Moreover, in the center part in the lateral direction of the fixing belt 1, no other member than the pressure pad 3 is in contact with the fixing belt 1, and dispersion of the heat will be depressed. Further, the shape of the fixing belt 1 can be maintained by the rigidity of the fixing belt itself which has a substantially cylindrical curved face.

Because a flexure may occur in the pad support member 4 so as to be curved by a load received from the pressure roll 2, this flexure is compensated by setting the contact face of the pressure pad 3 with respect to the fixing belt 1 to have a convex shape in the lateral direction of the fixing belt 1. Specifically, it is desirable to apply compensation to the pressure pad 3, in such a manner that in a flexed state of the pad support member 4, a plane where the pressure pad 3 is contacted with the inner face of the fixing belt 1 may be substantially in a straight line with a plane where the pressure roll 2 is contacted with the outer peripheral face of the fixing belt 1. In this manner, the axis of rotation of the fixing belt 1 will lie on a substantially straight line, and so, more smooth rotation and uniform pressurization can be obtained.

The gear parts 6*b* of the end cap members 6 are respectively meshed with driving gears 21. These driving gears 21 are driven by a motor 24 which is provided with a reduction mechanism, by way of driving force transmitting gears 22, 23. Besides the mechanism for transmitting the driving force by providing the gear parts 6*b* on the end cap members 6, the mechanism for transmitting the driving force to the end cap members 6 may include a mechanism for rotating the end cap members 6 by means of a belt or chain.

In the above described embodiment, only the fixing belt 1 is directly driven by the driving unit from the exterior. However, in some other systems, the driving force from the exterior may be applied also to the pressure roll 2, thereby to drive both the fixing belt 1 and the pressure roll 2. In this case, it is desirable to provide such a mechanism that in case where a difference in speed has occurred between the fixing belt 1 and the pressure roll 2, the driving force of either one of them can be interrupted so as to follow the speed of the other.

The aforesaid electromagnetic induction heater 5 has a base member 5*a* having a curved face corresponding to the shape of the fixing belt 1, exciting coils 5*b* held on the base member 5*a*, and an exciting circuit 5*c* which supplies high frequency current to these exciting coils 5*b*, as shown in FIG. 2. The exciting coils 5*b* are arranged along the outer peripheral face of the fixing belt 1 with a gap of a few millimeters from the outer peripheral face, and adapted to heat the electrically conductive layer 1*b* of the fixing belt 1. The base member 5*a* is formed of insulating and heat resistant material. For example, phenol resin, polyimide resin, polyamide resin, polyamideimide resin, liquid crystal polymer resin, etc. can be used.

The aforesaid exciting coils 5*b* have a substantially cylindrical curved shape on their faces opposed to the fixing belt 1, so that they can be opposed to the fixing belt 1 which is in a cylindrical shape with a certain interval. In order that a center axis of this cylindrical curved face may be in a line with the center axis of the rotation of the fixing belt 1, coil positioning members 7 are supported by the shafts 4*a* which determine the center axis of the fixing belt 1, whereby positions of the exciting coils 5*b* can be set by means of these coil positioning members 7. Specifically, as shown in FIG. 6, each of the coil positioning members 7 is in a form of a disc having a through hole at a center, and has such an inner diameter as being tightly fitted to each of the shafts 4*a* of the pad support member. An outer diameter of the coil positioning member 7 is so determined that the base member 5*a* or the exciting coil 5*b* may be contacted with an outer peripheral face thereof, thereby to set the position of the exciting coil 5*b*. By making the center axis of the cylindrical curved face of the exciting coil 5*b* in a line with the center axis of the curved face of the fixing belt in this manner, the distance between the exciting coil 5*b* and the peripheral face of the fixing belt 1 can be always correctly maintained.

When the high frequency current is supplied from the aforesaid exciting circuit 5*c* to the exciting coils 5*b*, magnetic fluxes are repeatedly generated and disappeared around the exciting coils 5*b*. Frequency of the high frequency current is set to be 10 to 50 kHz for example, and in this embodiment, the frequency of the high frequency current is set to be 30 kHz. When these magnetic fluxes traverse the electrically conductive layer 1*b* of the fixing belt 1, an eddy current will be generated in the electrically conductive layer so as to form a magnetic field for preventing a change of its magnetic field, and Joule heat will be generated with an electric power ($W=I^2R$) in proportion to skin resistance of the conductive layer 1*b*. The fixing belt 1 will be heated accordingly, and by controlling an amount of electric power to be supplied to the exciting coils 5*b* and a supplying time for the high frequency current, the fixing belt 1 can be kept at a determined temperature.

Then, operation of the above described fixing device will be described.

A toner image T formed by toners of four colors, namely, yellow, magenta, cyan, and black is formed in the image forming section, according to an image signal, and transferred to recording paper P by means of a transfer device which is not shown. This toner is formed of a binder of thermoplastic resin containing coloring pigments.

Meanwhile, the electric power is supplied to the motor 24 for driving the fixing belt 1 and the electromagnetic induction heater 5, substantially at the same time when the toner forming operation is started. Then, the fixing belt 1 is driven to rotate, and the pressure roll 2 will be rotated. The eddy current is induced to the electrically conductive layer 1*b* to heat the fixing belt 1, while the fixing belt 1 passes the heating region which is opposed to the electromagnetic induction heater 5. On this occasion, the fixing belt 1 is kept in contact with the engaging parts 6*a* of the end cap members 6 at the both end parts thereof, but circularly moves in the center part (the paper passing region), in contact with no member except the pressure pad 3. Therefore, the heat will be hardly deprived of by the other members, and efficient heating can be conducted. Moreover, the driving force is transmitted to the fixing belt 1 by way of the gear parts 6*a* of the end cap members 6 from both the side edges, and the fixing belt 1 will be smoothly driven to circularly move, without causing a slip or so, around the shafts 4*a* at both the ends of the pad support member, at the determined speed. For this reason, even though the friction force between the pressure pad 3 and the inner peripheral face of the fixing belt 1 has been increased due to long-term use, the rotation of the fixing belt 1 can be reliably maintained at the determined speed.

On the other hand, the fixing belt 1 is driven along the determined orbit, and it will not happen that the fixing belt sways in a direction perpendicular to the peripheral face, or a part of the fixing belt 1 in the endless state, except the fixing nip part, largely swings. Moreover, the positions of the exciting coils 5*b* are restricted by the coil positioning members 7 which are concentrically supported with the end cap members 6 which support the fixing belt 1, whereby the distance between the exciting coils 5*b* and the fixing belt 1 can be kept constant and uniform heating can be conducted.

The distance between the electrically conductive layer 1*b* of the fixing belt and the exciting coils 5*b* is a very important factor for conducting the heating at an appropriate temperature and uniformly. In case where this distance is too large, linkage between the exciting coils 5*b* and the electrically conductive layer 1*b* of the fixing belt becomes week, and consequently, heating efficiency will be deteriorated to make the warming up time longer. Moreover, the temperature of the fixing belt remarkably drops while the image formation is continuously conducted, and defective fixing may occur, or in the worst case, generation of the high frequency current may be stopped. On the contrary, in case where the distance is too short, the surface layer 1*d* of the fixing belt and the exciting coil 5*b* (or an exciting coil cover and so on) may get in touch with each other, and the surface of the fixing belt may be damaged to make a surface flaw on the fixed image. When the fixing belt 1 sways during the rotation, the distance between the exciting coils 5*b* and the electrically conductive layer 1*b* of the fixing belt will change, and the temperature variations in the rotation direction may occur, which appear as unevenness of luster on the fixed image. Further, the distance between the exciting coils 5*b* and the electrically conductive layer 1*b* of the fixing belt is different in a direction of the rotation axis, the temperature of the fixing belt at a position closer to the exciting coils may be elevated. As the results, it is likely to happen that the toner at the closer position will be melted too much to cause a hot offset, or on the contrary, the toner will not be melted at a remoter position to cause insufficient coloring of the image or a cold offset.

In this fixing device, the distance between the exciting coils 5*b* and the electrically conductive layer 1*b* of the fixing belt is correctly set by the coil positioning members 7, and the fixing belt 1 is stably driven along the determined orbit. Therefore, the distance between them is always maintained constant, and a determined distance can be kept in an axial direction too. Accordingly, the fixing belt 1 can be correctly heated up to the determined temperature, and substantially uniformly heated both in the circumferential direction and in the lateral direction.

In the state where the fixing belt 1 has been heated uniformly up to the determined temperature, the recording paper P carrying the unfixed toner image will be fed into the fixing nip part where the fixing belt 1 is brought into contact with the pressure roll 2. Inside the fixing nip part in the paper passing region, the recording paper P and the toner image T will be heated and pressurized, whereby the toner image T will be fixed onto the recording paper P. Because the fixing belt 1 has been uniformly heated up to the temperature suitable for fixing the toner image by this moment, troubles such as unevenness of luster, and offset can be prevented, and favorable fixation of the toner image can be performed.

Moreover, the pressure roll 2 is driven to rotate in association with the rotation of the fixing belt 1. Therefore, even though the outer diameter of the pressure roll 2 has changed according to the temperature, the recording paper passing through the fixing nip part will follow the circumferential running speed of the fixing belt 1 which is driven at the determined speed, and unbalance of the speed with the transfer step will not happen. Therefore, wrinkles of the paper and disturbances in the image will not happen.

Now, results of experiments and measurements conducted on the fixing device in the embodiment of the invention will be briefly explained.

Figure 8:
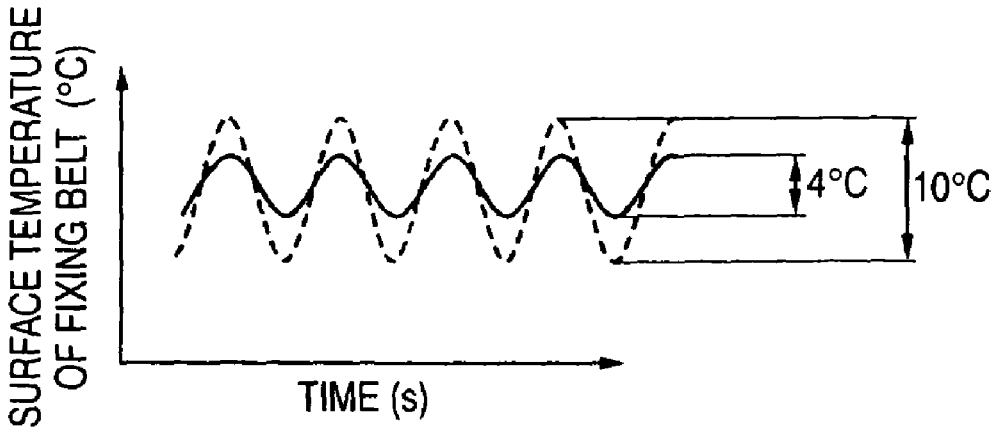
FIG. 8 is a graph showing temperature distribution in a circumferential direction of the fixing belt in the fixing device in the embodiment of the invention.

In the fixing device in this embodiment, a color image was transferred and fixed on a coated paper having high luster. When the thus fixed image was observed, unevenness of the luster cannot be detected. The surface temperature of the fixing belt during the fixing operation was measured continuously in the center part in the lateral direction, and the results as shown in FIG. 8 were obtained. Specifically, in the fixing device according to the invention, when the fixing belt moved circularly, deflection of the temperature, that is, variation of the temperature was about 4° C. In the conventional fixing device, a temperature difference of about 10° C. has sometimes happened when the fixing belt has been swaying. It is confirmed that the fixing device of the invention has been remarkably improved.

Figure 9:
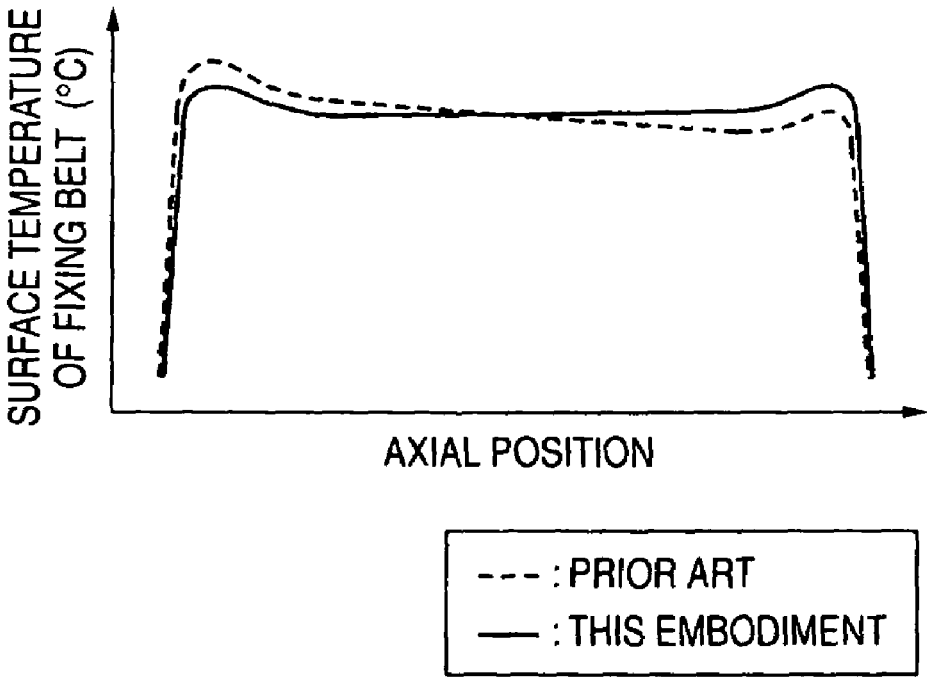
FIG. 9 is a graph showing temperature distribution in a lateral direction of the fixing belt in the fixing device in the embodiment of the invention.

On the other hand, distribution of the surface temperature of the fixing belt 1 in the lateral direction was measured. As shown in FIG. 9, in the fixing device of the invention, substantially even distribution was obtained in the paper passing region, in the lateral direction of the fixing belt. In the conventional fixing device, in case where the exciting coil has not been sufficiently correctly set, the luster of the image may be sometimes different in one side part of the fixed image from the other side part. When the temperature of the fixing belt was measured, it was found that at a side where the luster of the fixed image was high, the surface temperature of the fixing belt was higher by about 10° C. than at the other side, as shown by a dotted line in FIG. 9.

In the fixing device in the embodiment of the invention, because setting of the exciting coils can be correctly conducted, such a difference in the surface temperature of the fixing device will not happen, and the image having uniform luster can be obtained.

The entire disclosure of Japanese Patent Application No. 2004-229540 filed on Aug. 5, 2004 including specification, claims, drawings and abstract is incorporated herein by reference in its entirety.

What is claimed is:

1. A fixing device comprising:

an endless fixing belt which is tensionless in a circumferential direction at a center part of the width direction of the belt and supported to circularly move;

a heating device that heats the fixing belt;

a pressure roll which is contacted with an outer peripheral face of the fixing belt and supported to rotate around an axis of the pressure roll;

a pressure member which is contacted with an inner peripheral face of the fixing belt to exert pressure on the pressure roll interposing the fixing belt; and a support member which is passed through inside the fixing belt and supports the pressure member, wherein a fixing nip part is formed between the fixing belt and the pressure roll, an unfixed toner image on a recording medium which passes the nip part is pressured and heated to be a fixed image, the fixing belt is kept in a round shape in the circumferential direction near edges of both sides of the fixing belt, and the fixing belt is supported to rotate around a center axis which is determined by both end parts of the support member.

2. The fixing device as claimed in claim 1, wherein an end part restraining member is fitted to the edge parts of both sides of the fixing belt inside the fixing belt, the end part restraining member has a curved face having an outer diameter substantially equal to an inner diameter of the fixing belt, and the end part restraining members are rotatably fixed to the end parts of the support member.

3. The fixing device as claimed in claim 2, further comprising:

a driving unit that transmits a rotation driving force to the end part restraining members.

4. The fixing device as claimed in claim 1, wherein the fixing belt has an electrically conductive layer along its peripheral face of the fixing belt, the heating device is arranged to be opposed to the peripheral face of the fixing belt and heats the fixing belt by generating an eddy current in the electrically conductive layer, and a position where the heating device is arranged is restricted by a positioning member which is mounted on the center axis that supports the fixing belt.

5. A fixing device comprising:

a hollow fixing roll which is tensionless in a circumferential direction at a centerpart of a width direction of the belt and supported to circularly move;

a heating device that heats the fixing roll;

a pressure roll which is contacted with an outer peripheral face of the fixing roll and supported to rotate around an axis of the pressure roll;

a pressure member which is contacted with an inner peripheral face of the fixing roll to exert pressure on the pressure roll interposing the fixing roll; and a support member which is passed through inside the fixing roll and supports the pressure member, wherein a fixing nip part is formed between the fixing roll and the pressure roll, an unfixed toner image on a recording medium which passes the nip part is pressured and heated to be a fixed image, the fixing roll is kept in a round shape in the circumferential direction near edges of both sides of the fixing roll, and the fixing roll is supported to rotate around a center axis which is determined by both end parts of the support member.

6. A fixing device comprising:

an endless fixing belt supported to circularly move;

end part restraining members fitted to an inner surface of the fixing belt at edge parts of the fixing belt wherein the end part restraining members transmit a rotational driving force to the fixing belt; and a pressure roll that is contacted with an outer surface of the fixing belt.

7. The fixing device according to claim 6, wherein each outer surface of the end part restraining member is fixed to the inner surface of the fixing belt at the edge part of the fixing belt by an adhesive.

8. The fixing device according to claim 6, wherein:

each end part restraining member comprises an engaging part to be fitted to the inner surface of the fixing belt at the corresponding edge part of the fixing belt, and the engaging part of each end part restraining member has an outer diameter larger than an inner diameter of the fixing belt.

9. The fixing device according to claim 7, wherein the end part restraining members are made of one selected from the group consisting of phenol resin, polyimide resin, polyamide resin, polyamideimide resin, PEEK resin, PES resin, PPS resin and LCP resin.

10. The fixing device according to claim 7, further comprising:

a heating device that heats the fixing belt;

a pressure member that is contacted with the inner surface of the fixing belt to exert pressure on the pressure roll with the fixing belt interposed between the pressure member and the pressure roll; and a support member that is passed through inside the fixing belt and supports the pressure member.

11. The fixing device according to claim 10, wherein the heating device is disposed outside the fixing belt.

12. The fixing device according to claim 10, wherein an unfixed toner image on a recording medium, which is passed through a nip portion formed between the fixing belt and the pressure roller, is pressured and heated to be a fixed image.

13. The fixing device according to claim 7, wherein each end part restraining member has a curved face having an outer diameter substantially equal to an inner diameter of the fixing belt at the edge parts of the fixing belt.

14. The fixing device according to claim 7, further comprising:

a driving unit that transmits the rotational driving force to the end part restraining members.

15. The fixing device according to claim 7, further comprising:

a heating device disposed to be opposite to the outer surface of the fixing belt, wherein:

the fixing belt has an electrically conductive layer along the outer surface of the fixing belt, the heating device generates an eddy current in the electrically conductive layer of the fixing belt to heat the fixing belt, and a position where the heating device is arranged is restricted by a positioning member which is mounted on a center axis that supports the fixing belt.

* * * * *